United States Patent [19]

Moro et al.

[11] 4,297,815

[45] Nov. 3, 1981

[54] POWER ARM FITTED WITH COUPLING DEVICES FOR A MEMBER PROVIDED TO CONTROL ITS POSITION

[75] Inventors: Christian D. Moro, Saint Pathus; Daniel G. Ranini, Varreddes, both of France

[73] Assignee: Poclain, Belleville, France

[21] Appl. No.: 102,894

[22] Filed: Dec. 12, 1979

[30] Foreign Application Priority Data

Dec. 29, 1978 [FR] France ..... 78 36909

[51] Int. Cl.[3] ..... B66C 23/06; E02F 5/02

[52] U.S. Cl. ..... 52/115; 37/103; 414/727; 52/116

[58] Field of Search ..... 37/103, 117.5; 414/912, 414/685–688, 690–692, 694, 710, 715, 723–724, 742, 680, 695, 695.5, 722, 727, 735; 212/33; 52/115, 116; 74/522.5, 469

[56] References Cited

U.S. PATENT DOCUMENTS

| | | | |
|---|---|---|---|
| Re. 23,989 | 4/1955 | Wills et al. | 414/694 |
| 2,802,584 | 8/1957 | Przybylski | 414/685 |
| 2,828,038 | 3/1958 | Dorkins | 414/694 X |
| 2,973,874 | 3/1961 | Holopainen | 414/687 |
| 3,515,298 | 6/1970 | Guinot | 414/694 |
| 3,525,448 | 8/1970 | Bauer | 414/715 |
| 3,589,539 | 6/1971 | Witwer | 37/103 X |
| 4,077,140 | 3/1978 | Branconi | 414/686 |

FOREIGN PATENT DOCUMENTS

| | | | |
|---|---|---|---|
| 1127823 | 4/1962 | Fed. Rep. of Germany | 414/687 |
| 2347516 | 12/1976 | France | 414/687 |
| 6405240 | 11/1965 | Netherlands | 414/687 |

*Primary Examiner*—E. H. Eickholt
*Attorney, Agent, or Firm*—James E. Nilles

[57] ABSTRACT

The invention relates to a power arm comprising four faces, two of which being constituted by plates, which arm is mounted for pivotment about an axis and with respect to a structure, and is fitted with the coupling lug of a jack comprising a pivoting axis of said jack and its support, permitting a deflection of said jack which is parallel to the deflection of the arm, said support being constituted by extended portions of the plates.

The arm comprises a cross piece of which the length 1 is substantially equal to the spacing between the said extended portions and which is situated between the said extended portions, and transversed by the axis, a threaded end of which cooperates with a nut to hold the cross piece in position between the said extended portions.

An application is found in the production of a shovel boom.

2 Claims, 6 Drawing Figures

FIG. 1
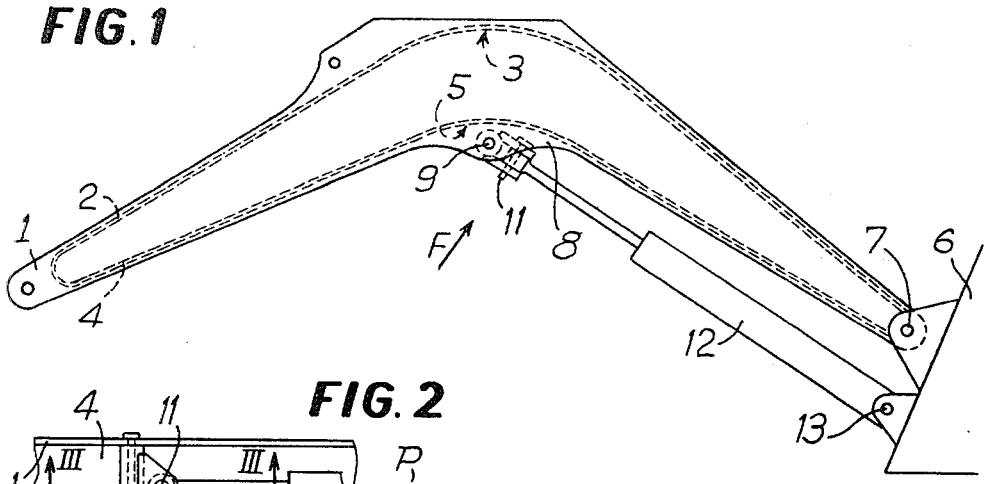
FIG. 2
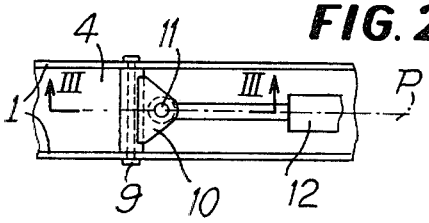
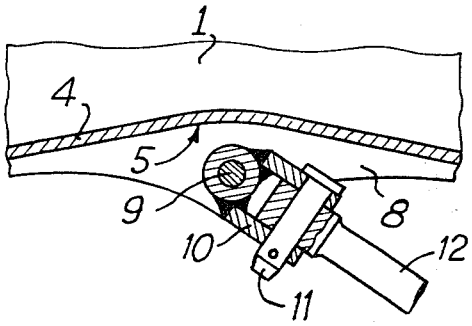
FIG. 3
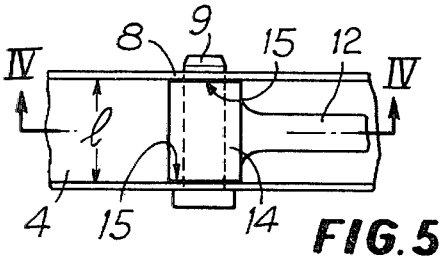
FIG. 5
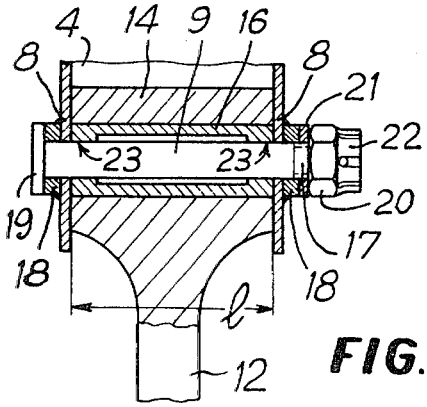
FIG. 6
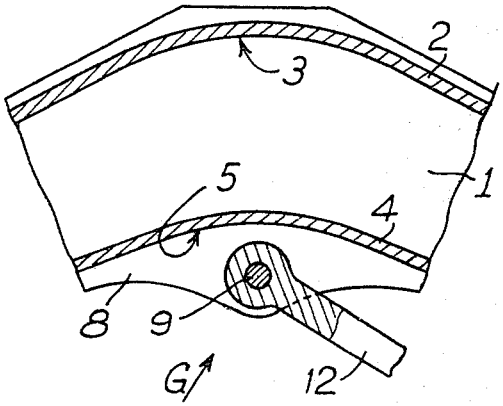
FIG. 4

POWER ARM FITTED WITH COUPLING DEVICES FOR A MEMBER PROVIDED TO CONTROL ITS POSITION

Power arms, intended for transmitting forces or driving torques, find multiple applications in public works machines. For example, in a hydraulically-operated shovel, they constitute the boom, pivotally mounted on the chassis or on the revolving turret, as well as the stick pivoting at the end of the said boom.

The position of a power arm should also be adjustable because of the very function of that arm. Position controlling members, generally constituted by jacks, are coupled, to this effect, between the power arms and the structures with respect to which they pivot.

The constitution of the devices coupling the jacks to the power arms are currently unsatisfactory to the non-integrated fixation of the coupling lug to the power arm, and of the non-adaptation of the coupling of the jack to the correct transmission of the forces.

It is the object of the present invention to remedy this state of affairs, by proposing new and simple arrangements, that are efficient and mechanically resistant.

The invention therefore relates to a power arm comprising four faces, generally parallel in pairs, two of which are constituted by plates, said arm being mounted to pivot, with respect to a structure, about an axis substantially perpendicular to the said plates, and being fitted with the coupling lug of a jack controlling its position with respect to the said structure. Said lug comprises in particular a jack pivoting device and its support, permitting a deflection of the said jack which is substantially parallel to the deflection of the arm with respect to the structure, and which is constituted by extending portions of the said plates, which portions extend beyond the faces of the arm which are separate from the said plates.

The arm comprises a tubular cross-piece, the length of which is substantially equal to the spacing between the extensions, which cross piece is located between the said extended portions and which is traversed by an axis provided with a threaded end, cooperating with a nut, to hold the cross piece in position between the said extended portions.

The following advantageous arrangments are also often adopted:

the said axis is radially supported by the cross piece;

the jack pivoting device is of a type permitting free deflections in two substantially perpendicular planes,—one plane parallel to the plates and one plane perpendicular to the plates;

the spacing between the extended portions of the plate is substantially equal to the width of the jack coupling lug.

The invention will be more readily understood on reading the following description with reference to the accompanying drawings, in which:

FIG. 1 is an elevational view of a boom of a hydraulically-operated shovel according to the invention;

FIG. 2 is a view along arrow F of FIG. 1;

FIG. 3 is a partial cross-section along III—III of FIG. 2;

FIG. 4 is a longitudinal cross-section, along IV—IV of FIG. 5, of a variant embodiment of a boom according to the invention;

FIG. 5 is a view along arrow G of FIG. 4, and

FIG. 6 is a cross-section through the coupling axis of its control jack, of another embodiment of a boom according to the invention.

The boom shown in FIGS. 1 to 3 is constituted by two plane vertical sides 1 to which are welded one upper plate, bent in 3, and one lower plate, bent in 5. Said boom is mounted for pivotment about an axis 7 and with respect to a structure 6, which, in the example shown, constitutes the revolving turret of a hydraulically-operated shovel.

In the area of the bent part 5 of the lower plate 4, portions 8 of the two sides extend beyond the said lower plate 4, and are used as supports for a pivoting axis 9, substantially parallel to the axis 7. A bearing 10 is mounted for pivotment about axis 9 and receives a second pivoting axis 11, which is substantially parallel to the longitudinal plane P of the boom. A hydraulic jack 12 is coupled between the axis 11 and an axis 13 parallel to the axis 7 and is placed on the structure 6.

The variant embodiment shown in FIGS. 4 and 5 repeats the constitution of the preceding embodiment except that there is no bearing 10. In these conditions, the jack 12 is coupled directly to the axis 9 by its end 14, forming a pivoting bearing. It should be noted that in this embodiment the width of the said end 14 is substantially equal to the spacing 1 between the inner faces 15 of the extender portions 8, although slightly less.

The arrangements shown in FIGS. 4 and 5 are also found in the embodiment shown in FIG. 6, but they have been completed. It is to be noted that a tubular cross piece 16 is placed between the extended portions 8 of the sides. The axis 9 is provided with a threaded end 17 and traverses the extended portions 8, as well as outer reinforcements 18 of said extended portions and the said cross piece 16. Its head 19 rests on one of the reinforcements 18, whereas a nut 20 presses a support washer 21 against the other reinforcement 18, as well as the extensions 8 against the ends of the cross piece 16. A locknut 22 prevents all loosening of the nut. The cross piece 16 is equal in length to the width 1 of the inner faces of the extensions 8. Moreover, the cross piece 16 comprises two radial bosses 23 defining ends of the cross piece which are flat and normal to the axis of the cross piece (FIG. 6), ensuring the radial position of the axis 9. The end 14 of the jack 12 is coupled about the cross piece 16 and its width is slightly less than 1 so as to allow its free deflection between the extended portions 8.

The advantages of the booms described hereinabove reside in the greater simplicity of constitution of the supports of the axis 9: these are not separate parts fixed on the sides 1 by welding, but rather the acutal extensions 8 of the sides.

It is advantageous, in order to avoid that strong stray forces are exercised on the said extended portions 8, which would not be parallel to their plane (and to plane P), to couple the jack 12, by way of a universal type double axis (9-11) joint.

It is equally advantageous to prevent the extended portions 8 from overturning. This is done due to the effect of the axis 9 selected in FIG. 6: the nut 20 and the head 19 of the axis totally prevent the plates from overturning outwardly whereas the cross piece 16 prevents any inward overturning.

Of course, the radial bearings 23 of the cross piece prevent any radial clearance of the axis 9 in the cross piece.

The invention is not limited to the embodiments described hereinabove, but on the contrary covers any variant that may be made thereto without departing from its scope or its spirit.

Another application to be noted is in the production of the stick supporting the bucket of the shovel.

We claim:

1. A power arm comprising four faces, generally parallel in pairs, two of which are constituted by plates, said arm being mounted to pivot, with respect to a structure, about an axis substantially perpendicular to the said plates, and being fitted with a tubular coupling lug of a jack controlling its position with respect to the said structure, said plates each having an integrally formed extending portion intermediate the length of said arm and extending beyond the faces of said arm, said lug comprising a jack pivoting device and its support, permitting a deflection of said jack which is substantially parallel to the deflection of the arm with respect to the structure, and which is constituted by said extending portions of the said plates, a tubular cross piece located within said tubular lug and having flat ends which are normal to the axis of said cross piece and located between said extending portions, the length of said cross piece being substantially equal to the spacing between the extending portions so as to act as a brace and prevent the portions from turning inwardly, said tubular lug being mounted on said cross piece for relative rotation with respect thereto, said tubular lug being of shorter length than the distance between said extending portions of said plates so as to permit free rotation of said tubular lug, and said cross piece prevents friction braking between said plate portions and said lug, said cross piece having an axis therein and which axis is provided with a threaded end, cooperating with a nut, to hold the cross piece in position between the said extending portions.

2. A power arm as claimed in claim 1, wherein the jack pivoting device is of a type permitting free deflections in two substantially perpendicular planes, one plane parallel to the plates, and one plane perpendicular to the plates.

* * * * *